US010195535B2

(12) United States Patent
Koide et al.

(10) Patent No.: US 10,195,535 B2
(45) Date of Patent: Feb. 5, 2019

(54) TRANSPORTABLE INFLATABLE SURFING APPARATUS AND METHOD

(71) Applicant: Whitewater West Industries Ltd., Richmond (CA)

(72) Inventors: Brad Jiro Koide, San Diego, CA (US); Marshall Corey Myrman, San Diego, CA (US)

(73) Assignee: WHITEWATER WEST INDUSTRIES LTD., Richmond, BC (CA)

( * ) Notice: Subject to any disclaimer, the term of this patent is extended or adjusted under 35 U.S.C. 154(b) by 0 days.

(21) Appl. No.: 15/350,977

(22) Filed: Nov. 14, 2016

(65) Prior Publication Data

US 2017/0136368 A1 May 18, 2017

Related U.S. Application Data

(60) Provisional application No. 62/254,573, filed on Nov. 12, 2015.

(51) Int. Cl.
*A63G 21/00* (2006.01)
*B65D 88/00* (2006.01)
(Continued)

(52) U.S. Cl.
CPC ..... *A63G 21/00* (2013.01); *A63B 69/0093* (2013.01); *A63G 31/00* (2013.01); *A63G 31/007* (2013.01); *B65D 88/005* (2013.01); *B65D 90/0033* (2013.01); *B65D 90/18* (2013.01); *A63G 2200/00* (2013.01); *B65D 88/121* (2013.01)

(58) Field of Classification Search
CPC ..... A63G 21/00; A63G 21/18; A63G 31/00; A63G 31/007; B65D 88/00; B65D 88/005; B65D 88/12; B65D 88/20; B65D 90/00; B65D 90/0033; B65D 90/18
USPC ..... 220/1.5; 206/315.1; 472/116–117
See application file for complete search history.

(56) References Cited

U.S. PATENT DOCUMENTS 490,484 A 1/1893 Mackaye
586,718 A 7/1897 Wharton, Jr.
(Continued)

FOREIGN PATENT DOCUMENTS

AU 668713 5/1996
AU 703850 10/1996
(Continued)

OTHER PUBLICATIONS

ISR and Written Opinion for PCT/US2014/031322, 2014 dated Aug. 20, 2014.

*Primary Examiner* — Bryon Gehman
(74) *Attorney, Agent, or Firm* — Buchalter PC

(57) ABSTRACT

A system, apparatus, and method for transporting an amusement attraction, such as an inflatable surfing attraction. A shipping container may be provided that is modifiable (e.g., has removable or rotatable elements such that it may be converted from a transporting orientation for containing one or more components of the attraction within for shipment to a deployed orientation whereby one or more of its elements may be used for setup and/or operation of the attraction. The attraction may incorporate an automatic inflating system that monitors pressure or other characteristics during setup.

19 Claims, 3 Drawing Sheets

(51) Int. Cl.

| | |
|---|---|
| ***B65D 90/00*** | (2006.01) |
| ***B65D 90/18*** | (2006.01) |
| ***A63B 69/00*** | (2006.01) |
| ***A63G 31/00*** | (2006.01) |
| *B65D 88/12* | (2006.01) |

(56) References Cited

U.S. PATENT DOCUMENTS 586,983 A 7/1897 Wharton, Jr.
799,708 A 9/1905 Boyce
1,392,533 A 10/1921 Smyth
1,536,875 A 5/1925 Bowen
1,655,498 A 1/1928 Fisch
1,701,842 A 2/1928 Fisch
1,871,215 A 8/1932 Keller
1,884,075 A 10/1932 Meyers
2,117,982 A 5/1938 Prince, Jr.
2,558,759 A 7/1951 Johnson
2,815,951 A 12/1957 Baldanza
3,005,207 A 10/1961 Matrai
3,038,760 A 6/1962 Crooke
3,085,404 A 4/1963 Smith
3,120,385 A 2/1964 Hall
3,216,455 A 11/1965 Cornell
3,363,583 A 1/1968 Greenberg
3,473,334 A 10/1969 Dexter
3,477,233 A 11/1969 Andersen
3,478,444 A 11/1969 Presnell
3,497,211 A 2/1970 Nagin
3,547,749 A 12/1970 White
3,557,559 A 1/1971 Barr
3,562,823 A 2/1971 Koster
3,565,491 A 2/1971 Fraizer
3,598,402 A 8/1971 Frenzl
3,611,727 A 10/1971 Blandford
3,613,377 A 10/1971 Zaugg
3,757,370 A 9/1973 Seno
3,789,612 A 2/1974 Richard
3,802,697 A 4/1974 Le Mehaute
3,845,510 A 11/1974 Baker
3,850,373 A 11/1974 Grolitsch
3,851,476 A 12/1974 Edwards
3,853,067 A 12/1974 Bacon
3,913,332 A 10/1975 Forsman
3,981,612 A 9/1976 Bunger
4,062,192 A 12/1977 Biewer
4,087,088 A 5/1978 Kelso
4,122,560 A 10/1978 Baker
4,147,844 A 4/1979 Babinky
4,149,710 A 4/1979 Rouchard
4,196,900 A 4/1980 Becker
4,197,815 A 4/1980 Brazelton
4,198,043 A 4/1980 Timbes
4,201,496 A 5/1980 Andersen
4,244,768 A 1/1981 Wiechowski et al.
4,246,980 A 1/1981 Miller
4,276,664 A 7/1981 Baker
4,278,247 A 7/1981 Joppe
4,339,122 A 7/1982 Croul
4,374,169 A 2/1983 Gryskiewicz et al.
4,429,867 A 2/1984 Barber
4,474,369 A 10/1984 Gordon
4,522,535 A 6/1985 Bastenhof
4,539,719 A 9/1985 Schuster
4,557,475 A 12/1985 Donovan
4,561,133 A 12/1985 Laing
4,564,190 A 1/1986 Frenzyl
4,574,107 A 3/1986 Ferrari
4,662,781 A 5/1987 Tinkler
4,707,869 A 11/1987 Ray
4,736,912 A 4/1988 Loebert
4,790,155 A 12/1988 Daniel
4,790,685 A 12/1988 Scott
4,792,260 A 12/1988 Sauerbier
4,805,897 A 2/1989 Dubeta
4,806,048 A 2/1989 Ito
4,836,521 A 6/1989 Barber
4,903,959 A 2/1990 Barber
4,905,987 A 3/1990 Frenzl
4,954,014 A 9/1990 Sauerbier
4,976,422 A 12/1990 Shimamura
4,988,364 A 1/1991 Perusich et al.
5,020,465 A 6/1991 Langford
5,061,211 A 10/1991 Barber
5,125,577 A 6/1992 Frankel
5,170,901 A * 12/1992 Bersani ..... E04B 1/3431 220/1.5
5,171,101 A 12/1992 Sauerbier
5,183,438 A 2/1993 Blom
5,213,547 A 5/1993 Lochtefeld
5,219,315 A 6/1993 Fuller
5,236,280 A 8/1993 Lochtefeld
5,236,404 A 8/1993 Maclennan
RE34,407 E 10/1993 Frenszl
5,267,812 A 12/1993 Suzuki
5,271,692 A 12/1993 Lochtefeld
5,285,536 A 2/1994 Long
5,314,383 A 5/1994 Faldori
5,342,145 A 8/1994 Cohen
5,370,591 A 12/1994 Jewell
5,378,197 A 1/1995 Briggs
5,384,019 A 1/1995 Keating
5,385,518 A 1/1995 Turner
5,387,159 A 2/1995 Hilgart
5,393,170 A 2/1995 Lochtefeld
5,401,117 A 3/1995 Lochtefeld
5,421,782 A 6/1995 Lochtefeld
5,427,574 A 6/1995 Donnelly-Weide
5,447,636 A 9/1995 Banarjee
5,453,054 A 9/1995 Lochtefeld
5,503,597 A 4/1996 Lochtefeld
5,524,310 A 6/1996 Farnen
5,540,662 A 7/1996 Gold
5,564,859 A 10/1996 Lochtefeld
5,621,925 A 4/1997 Bastenhof
5,628,584 A 5/1997 Lochtefeld
5,638,556 A 6/1997 Kipers
5,667,445 A 9/1997 Lochtefeld
5,676,601 A 10/1997 Saunders
5,738,590 A 4/1998 Lochtefeld
5,779,553 A 7/1998 Langford
5,827,608 A 10/1998 Rinehart et al.
5,899,633 A 5/1999 Lochtefeld
5,899,634 A 5/1999 Lochtefeld
5,937,586 A 8/1999 Scherba
6,019,547 A 2/2000 Hill
6,112,489 A 9/2000 Zweig
6,132,317 A 10/2000 Lochtefeld
6,312,341 B1 11/2001 Healy
6,319,137 B1 11/2001 Lochtefeld
6,336,771 B1 1/2002 Hill
6,345,791 B1 2/2002 McClure
6,363,677 B1 4/2002 Chen
6,375,578 B1 4/2002 Briggs
6,491,589 B1 12/2002 Lochtefeld
6,527,646 B1 3/2003 Briggs
6,616,542 B1 9/2003 Reddick
6,676,530 B2 * 1/2004 Lochtefeld ..... A63G 31/007 472/117
6,716,107 B2 4/2004 Lochtefeld
6,726,403 B1 4/2004 Kriticos
6,758,231 B1 7/2004 Lochtefeld
6,796,096 B1 9/2004 Heath
6,920,651 B2 7/2005 Roberts
7,547,255 B2 6/2009 Lochtefeld
7,607,271 B2 10/2009 Griffin
7,666,104 B2 2/2010 Lochtefeld
7,717,645 B2 5/2010 McLaughlin
7,775,895 B2 8/2010 Henry
7,789,804 B1 9/2010 Phillips
7,951,011 B2 * 5/2011 Lochtefeld ..... A63G 21/18 472/117
8,042,200 B2 10/2011 Webber
8,056,295 B2 11/2011 Cappelle

(56) References Cited

U.S. PATENT DOCUMENTS

| | | | | |
|---|---|---|---|---|
| 8,088,016 | B2 | 1/2012 | Murphy | |
| 8,550,926 | B2 | 10/2013 | Lochtefeld | |
| 8,641,532 | B2 | 2/2014 | Lochtefeld | |
| 8,641,543 | B2 * | 2/2014 | Lochtefeld | A63G 21/18 472/117 |
| 8,784,224 | B1 * | 7/2014 | Schafer | A63G 21/18 472/116 |
| 8,882,604 | B2 | 11/2014 | Lochtefeld | |
| 9,072,927 | B2 * | 7/2015 | Sammann | A63B 17/00 |
| 9,194,146 | B2 | 11/2015 | Murphy | |
| 9,254,428 | B2 | 2/2016 | Kriticos | |
| 9,463,390 | B2 * | 10/2016 | Vicente | A63G 21/18 |
| 9,550,127 | B2 | 1/2017 | Lochtefeld | |
| 9,795,890 | B1 * | 10/2017 | Bradshaw | A63G 31/007 |
| 9,878,255 | B2 | 1/2018 | Kriticos | |
| 2003/0004003 | A1 | 1/2003 | Lochtefeld | |
| 2003/0029109 | A1 | 2/2003 | Hellberg | |
| 2003/0153221 | A1 | 8/2003 | Weir | |
| 2003/0154681 | A1 | 8/2003 | Pletzer | |
| 2004/0216226 | A1 | 11/2004 | Demarateau | |
| 2004/0244636 | A1 | 12/2004 | Meadow | |
| 2004/0245780 | A1 | 12/2004 | Roberts | |
| 2005/0148398 | A1 | 7/2005 | Lochtefeld | |
| 2006/0009343 | A1 | 5/2006 | Unterweger | |
| 2006/0093435 | A1 | 5/2006 | Unterweger | |
| 2007/0167246 | A1 | 7/2007 | McKee | |
| 2008/0044621 | A1 | 2/2008 | Strauss | |
| 2008/0216427 | A1 | 9/2008 | Lochtefeld | |
| 2008/0262666 | A1 | 10/2008 | Manning | |
| 2008/0286048 | A1 | 11/2008 | Camahan | |
| 2008/0293505 | A1 | 11/2008 | Northam | |
| 2009/0029785 | A1 | 1/2009 | McKee | |
| 2009/0137330 | A1 | 5/2009 | Sefchick | |
| 2009/0169305 | A1 | 7/2009 | Lochtefeld | |
| 2011/0045916 | A1 | 2/2011 | Casimaty | |
| 2011/0314589 | A1 | 12/2011 | Vito et al. | |
| 2012/0037198 | A1 * | 2/2012 | Cantin | E04B 1/3442 220/1.5 |
| 2013/0130815 | A1 | 1/2013 | Lochtefeld | |
| 2013/0074254 | A1 | 3/2013 | Payne et al. | |
| 2013/0130615 | A1 | 7/2013 | Lochtefeld | |
| 2013/0281221 | A1 | 10/2013 | Bowen | |
| 2014/0357387 | A1 | 12/2014 | Murphy | |
| 2015/0057093 | A1 | 2/2015 | Murphy | |
| 2015/0065261 | A1 | 3/2015 | Lochtefeld | |
| 2015/0119155 | A1 | 4/2015 | Vicente | |
| 2015/0273353 | A1 | 10/2015 | Coleman | |
| 2016/0076267 | A1 | 3/2016 | Murphy | |
| 2016/0354700 | A1 * | 12/2016 | Vicente | A63G 21/18 |
| 2017/0136368 | A1 | 5/2017 | Koide | |
| 2017/0136371 | A1 | 5/2017 | Vicente | |
| 2017/0136372 | A1 | 5/2017 | Koide | |
| 2017/0136373 | A1 | 5/2017 | Vicente | |

FOREIGN PATENT DOCUMENTS

| | | |
|---|---|---|
| AU | 774900 | 7/2004 |
| AU | 2002307400 | 3/2007 |
| AU | 2007201135 | 4/2007 |
| AU | 2008321385 | 5/2009 |
| AU | 2009202257 | 7/2009 |
| AU | 2011349052 | 12/2011 |
| BR | PI0721429-4 | 3/2014 |
| CA | 2090878 | 3/1992 |
| CA | 2444510 | 10/2002 |
| CA | 2680562 | 4/2009 |
| CA | 2705677 | 5/2009 |
| CA | 2824789 | 12/2011 |
| CA | 02856807 | 5/2013 |
| CA | PCT/CA14/00644 | 8/2014 |
| CA | 2852868 | 11/2014 |
| CA | 2869343 | 4/2015 |
| CA | 2922576 | 2/2016 |
| CH | 176562 | 4/1935 |
| CN | 101965147 | 10/2002 |
| CN | 1377291 A | 2/2011 |
| CN | 10411244 A | 10/2014 |
| DE | 159793 | 8/1903 |
| DE | 271412 | 11/1912 |
| DE | 373684 | 4/1932 |
| DE | 1210155 | 2/1966 |
| DE | 2222594 | 11/1973 |
| DE | 2714223 | 10/1978 |
| DE | 96216 | 2/1983 |
| DE | 3445976 | 12/1984 |
| DE | 69114013 | 4/2002 |
| EP | 0096216 | 12/1983 |
| EP | 0298853 | 1/1989 |
| EP | 0547117 | 10/1995 |
| EP | 0629139 | 5/1997 |
| EP | 02762145.7 | 11/2003 |
| EP | 1381435 | 9/2012 |
| EP | 2219504 | 2/2013 |
| ES | 2219504 | 2/2001 |
| FR | 1019527 | 1/1953 |
| FR | 1300144 | 8/1962 |
| FR | 1539959 | 9/1968 |
| FR | 2671977 | 7/1992 |
| GB | 375684 | 6/1932 |
| GB | 1090262 | 11/1967 |
| GB | 1118083 | 6/1968 |
| GB | 1159269 | 7/1969 |
| GB | 1204629 | 9/1970 |
| GB | 1210155 | 10/1970 |
| GB | 2219504 | 12/1989 |
| GB | 2223414 | 4/1990 |
| GR | 3018707 | 4/1996 |
| JP | 52-41392 | 3/1977 |
| JP | 3258280 | 1/2000 |
| JP | 5371152 | 1/2011 |
| JP | 2913834 | 4/2011 |
| NO | 310138 | 12/1992 |
| PT | 2219504 | 8/2010 |
| SU | 682238 | 8/1979 |
| SU | 953075 | 8/1982 |
| WO | PCT/US02/12250 | 2/2002 |

* cited by examiner

TRANSPORTABLE INFLATABLE SURFING APPARATUS AND METHOD

CROSS REFERENCE TO RELATED APPLICATIONS

This application claims the benefit of U.S. Provisional Patent Application Ser. No. 62/254,573, filed on Nov. 12, 2015, entitled "TRANSPORTABLE SURFING APPARATUS AND METHOD," which is hereby incorporated by reference in its entirety.

BACKGROUND

1. Field

The present invention relates generally to amusement attractions, such as surfing simulators or other wave machines. More particularly, the present invention relates to mobile surfing attractions that incorporate one or more inflatable sections or areas and are configured to be temporarily installed at a location after shipment.

2. Description of the Related Art

Water attractions (e.g., waterslides, surfing slides or machines, boogie-boarding slides, etc.) are a popular entertainment activity during periods of warm weather. Conventional water attractions are commonly made of fiberglass or other rigid or semi-rigid materials that provide a smooth and slippery surface for supporting a flow of water thereon to transport a rider from an entrance to an exit. A variety of different types of ride vehicles (e.g., inner tubes, body boards, surf boards, floatation devices, etc.) may be used by the rider as the rider travels along the water attraction and support the rider as the ride vehicle slides along the riding surface.

One type of water attraction that has proven a popular lure for patrons to water or other amusement parks or venues is the surfing machine or simulator. These machines may be used both for entertainment purposes as well as training purposes for helping instruct individuals that may be wary or otherwise unable to surf out in the open ocean. Conventional surf machines utilize water pumps cooperating with nozzles or jets to introduce water over a variety of surfaces and allow riders to travel atop or in the water flow. A riding surface of the conventional surf machine is typically a rigid or semi-rigid, low-friction surface that supports maneuvering by riders upon a conventional or modified surfboard or boogie board (individually and collectively referred to as a "board"). However, riders commonly fall off of the board during use of the surfing machine and the surfaces of these apparatuses can make uncomfortable contact with a rider upon the rider's falling off of their ride vehicle.

Particularly at competition or sports venues (e.g., surfing competitions, BMX competitions, etc.) located outdoors, such as at or near the beach, surfing simulators have increasingly been in demand as a fun and revenue-generating activity for potential patrons. Surfing simulators also provide onlookers with an additional activity to engage in while present at the venue or event. Unfortunately, given the relatively short duration that many competitions extend, some lasting only a few days in duration, permanent installation of surfing simulators at those locations is not cost effective. While some mobile surfing simulators have been developed, the comparably long and typically complex assembly and/or disassembly procedures, oftentimes taking greater time than the entire duration of the event itself, makes such devices undesirable to many potential event holders or organizers. These conventional simulators commonly utilize a large number of component parts that require vast numbers of shipment containers for their assembly, adding significantly to the cost associated with transporting and assembling the simulators at a desired geographic location.

As the sheet flow or deep flow standing wave product (collectively "surfing machine") market becomes more popular, water venues increasingly look to new surfing machines that can provide novel experiences to riders or that are less expensive or time consuming to install. Moreover, as the surfing industry becomes more sophisticated and the influence of extreme sports becomes more popular, more extreme conditions created by such surfing machines are desired in order to satisfy the thrill anticipated by these new generation of users, both adults and children alike. As new surfing machines are developed, maneuverability, rider comfort, cost, and efficiency in assembly/disassembly should be adequately addressed and improvements to ensure cost effectiveness, particularly in the mobile water attraction market, is desired. Rider comfort and/or improvements to rider maneuverability would also be desired. Ideally, a mobile surfing simulator would be inexpensive to construct and/or transport, quick and/or easy to assemble and/or disassemble, and would allow a rider to make contact with the surface of the water attraction, for example, upon falling off of a ride vehicle, with minimal discomfort.

SUMMARY

A water attraction or ride vehicle using inflatable materials is disclosed that is configured to be contained within a shipping container that unfolds or otherwise disassembles and then inflates within or connected with one or more portion of the unfolded or disassembled shipping container. In one embodiment, a system for transporting a surfing apparatus may include a housing having at least a first side and a second side, a ride surface configured to be disposed within the housing for transport of the ride surface from a first geographic location to a second geographic location, at least a portion of the ride surface being inflatable, and a water delivery mechanism configured to be disposed within the housing for transport of the water delivery mechanism from the first geographic location to the second geographic location. The first side may be configured to be modified with respect to the second side for setup of the ride surface at the second geographic location and wherein the ride surface is configured to be fastened with the first side at the second geographic location for use by one or more riders.

In another embodiment, a system for transporting an amusement attraction may include a housing having a transporting configuration and a deployed configuration, and a ride surface of the amusement attraction, the ride surface connected with a portion of the housing when in the transporting configuration. The housing may be configured to convert from the transporting configuration to the deployed configuration for providing support for the ride surface of the amusement when in the deployed configuration.

In still another embodiment, a system for shipping a water attraction may include a housing having a transporting configuration and a deployed configuration, and a ride surface of the amusement attraction. The housing may be configured to convert from the transporting configuration to the deployed configuration for providing support for the ride surface of the water attraction when in the deployed configuration.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale and may be exaggerated to better illustrate the important features of the present invention. In the drawings, like reference numerals designate like parts throughout the different views, wherein:

DETAILED DESCRIPTION

The detailed description of exemplary embodiments herein makes reference to the accompanying drawings and pictures, which show the exemplary embodiments by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
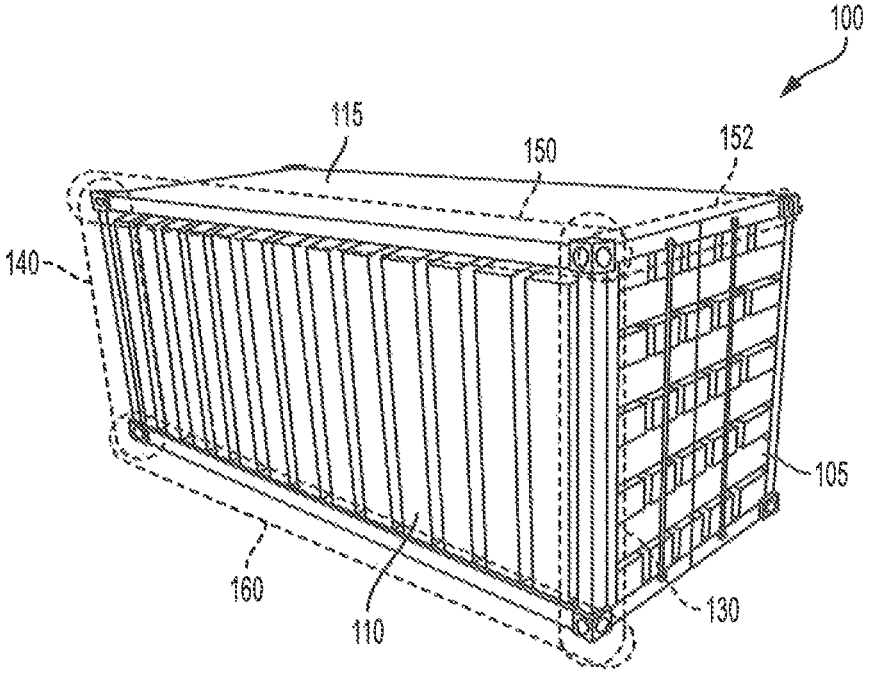
FIG. 1 shows a perspective view of a shipping container for shipping an inflatable surfing apparatus and configured to at least partially disassemble for installation or setup of the surfing apparatus according to an embodiment of the present invention.

FIG. 1 illustrates a shipping container 100 for shipping an inflatable surfing apparatus. The inflatable surfing apparatus may be any of a variety configurations, for example, as discussed in more detail in FIG. 2. In an alternative embodiment, other rides, attractions, or equipment (e.g., having inflatable portions or without inflatable portions) may be configured to be shipped within the shipping container 100 having features and/or operation that is similar to those described throughout. Although the shipping container 100 specifically illustrated in FIG. 1 illustrates an embodiment having particular mechanical connections, shapes, and/or other characteristics, alternative embodiments may have any of a variety of same, similar, or different connections, shapes, or other characteristics.

The shipping container 100 is shown in the transporting orientation. In this orientation, the shipping container 100 may contain various components or elements of an inflatable surfing apparatus therein and provide a convenient container or housing for placement upon a transporting vehicle (e.g., truck, train, airplane, boat, forklift, etc.). In one embodiment, the shipping container may be made of metal, for example, in order to have strong endurance and/or durability for protection of one or more of the various components or elements contained therein. In an alternative embodiment, any of a variety of materials may be used (e.g., carbon fiber, plastics, etc.)

The shipping container 100 is a housing that has a first side 105, a second side 110, and a third side 115. For the purposes of illustration, the first side 105 may be a vertical side, the second side 110 may be another vertical side that is connected at a substantially 90 degree angle with the first side 105, and the third side 115 may be a horizontal side that is connected at a substantially 90 degree angle with both the first side 105 and the second side 110, as shown. Additional sides (not shown due to their obstruction from view in FIG. 1) may make up the remaining sides of the housing, including a side that is disposed parallel to the third side 115 (e.g., a bottom side), a side that is disposed parallel to the second side 110 and a side that is disposed parallel to the first side 105. Thus, in one embodiment, the shipping container 100 may be a 6-sided box or cube that is hollow or semi-hollow to allow for the placement of components or elements therein.

The first side 105 and the second side 110 may be connected via one or more fasteners or connectors 130 disposed along all or a portion of their connecting edges. In one embodiment, the one or more fasteners or connectors 130 may only be disposed at a specific location along the edge and/or at a corner where the first side 105 meets with the second side 110. The one or more fasteners or connectors 130 may allow for the first side 105 and the second side 110 to be completely disconnected from one another. Such fasteners or connectors 130 may, in such an embodiment, take the form of brackets, hinges, bolts, etc. that may allow for removal and subsequent reattachment of the first side 105 and/or the second side 110 to one another.

In another embodiment, the one or more fasteners may allow for the first side 105 and the second side 110 to instead remain connected with one another, but to change their orientation (e.g. rotate, pivot, etc.) with respect to one another. Such fasteners or connectors 130 may, in such an alternative embodiment, take the form of hinges that allow for such rotation. In some embodiments, changes in orientation between the first side 105 and the second side 110 may also be capable of being completely disconnected. Additional locking or securing elements may be used in order to substantially fix a desired orientation of the first side 105 and the second side 110 with respect to one another (e.g., in order to provide a base for stability or other purposes during operation of a surfing apparatus, as discussed in greater detail herein).

Similarly, the second side 110 and the third side 115 may be connected via one or more fasteners or connectors 150 disposed along all or a portion of their connecting edge. Likewise, the first side 105 and the third side 115 may be connected via one or more fasteners or connectors 152 disposed along all or a portion of their connecting edge. The same or similar to the discussion above, the one or more fasteners or connectors (150, 152) may allow for the second side 110 and/or the first side 105 to be completely disconnected from the third side 115. Such fasteners or connectors (150, 152) may, in such an embodiment, take the form of brackets, hinges, bolts, etc. that may allow for removal and subsequent reattachment of the second side 110 and/or first side 105 to the third side 115. Likewise, the same or similar to the description above, in another embodiment, the one or more fasteners or connectors (150, 152) may allow for the second side 110 and/or the first side 105 to remain connected with the third side 115, but allow them to change their orientation (e.g., rotate, pivot, etc.) with respect to one another. Such fasteners or connectors (150, 152) may, in such an alternative embodiment, take the form of hinges that allow for such rotation. In some embodiments, changes in orientation between the second side 110 and/or the first side 105 with respect to the third side 115 may also be capable of being completely disconnected. Additional locking or securing elements may be used in alternative embodiments in order to substantially fix a desired orientation of the second side 110 and/or the first side 105 with the third side 115 (e.g., in order to provide a base for stability or other purposes during operation of a surfing apparatus, as discussed in greater detail herein).

Like discussed above, other fasteners or connectors (140, 160) may be disposed on the remaining edges and/or corners of the second side 110. For example, in an embodiment of removable sides, this may allow for the second side 110 to be completely removed from the rest of the housing making up the shipping container 100. Likewise, similar features or operation may be permitted for the first side 105, the third side 115, and/or any other side or portion of the shipping container 100. As discussed in greater detail for FIG. 2, this may allow for the shipping container 100 to be at least partially (or fully) disassembled or otherwise modified after shipment in order to serve as one or more elements or bases for an installed surfing apparatus (e.g., having inflatable components in one embodiment) whose one or more components were shipping within the shipping container 100 while it is was in the transporting orientation.

Although the above description for FIG. 1 focused upon a mere shipping container or crate, any of a variety of other possible shipment possibilities, alternative to mere containers may be utilized and encompass features that are the same as or similar to those discussed above. For example, in one embodiment, the shipping container may be a trailer (e.g., a crate having one or more wheels) that is configured to be towed or rolled by a further vehicle down a roadway. In another example, the shipping container may be a vehicle that is capable of moving by its own power supply (e.g., rather than being towed by a second vehicle). Such a vehicle may be a truck or other automobile (e.g., railway car and/or train vehicle) that includes a shipping container, such as shipping container 100) that is removeable from a portion of the automobile and/or is not removeable, but may disassemble, fold, rotate, or otherwise include features the same as or similar to those discussed herein for the assembly of a ride attraction at a desired location. Although the shipping container 100 is illustrated as substantially symmetric, in other embodiments, any of a variety of shapes, configurations, and/or sizes in alternative embodiments.

Figure 2:
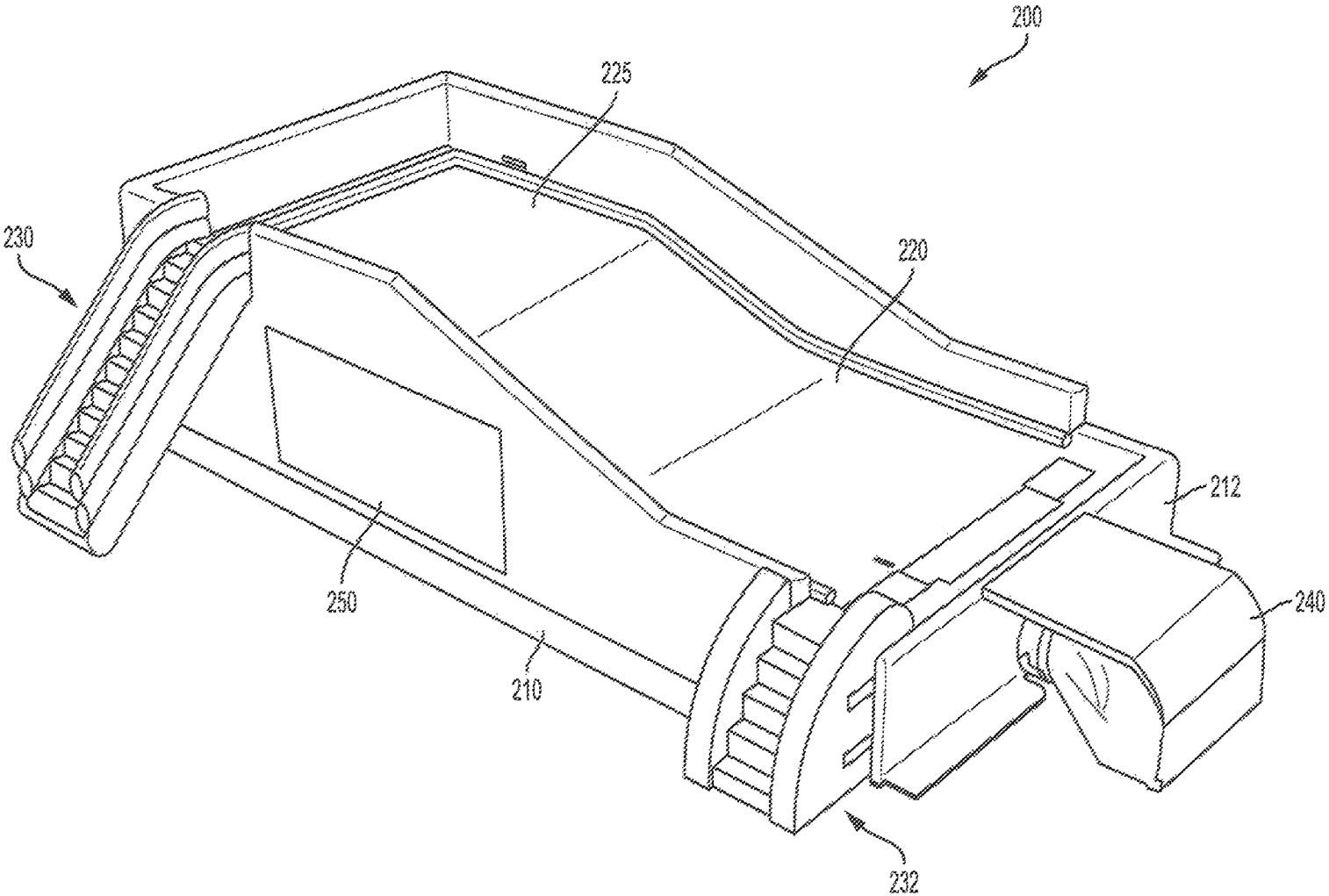
FIG. 2 shows an inflatable surfing apparatus configured to be shipped via a shipping container and installed or setup in cooperation with at least a portion of the shipping container according to an embodiment of the present invention.

FIG. 2 shows an inflatable surfing apparatus 200 configured to be shipped all or in part via a shipping container (e.g., the shipping container 100 of FIG. 1) and installed or setup in cooperation with at least a portion of the shipping container. As previously discussed, in alternative embodiments, the shipping container may be or may be part of a car, truck, railway vehicle, and/or other type of automobile. In one embodiment, a portion of the surfing apparatus 200 may be permanently connected with a portion of the shipping container such that the shipping container may be used to transport the surfing apparatus 200 and also be used as part of the surfing apparatus 200 deployed configuration. In another embodiment, the shipping container may be configured to be used for part of the surfing apparatus 200 when in its deployed configuration, but is not permanently connected, instead becomes connected or integrated during the assembly process of the surfing apparatus 200. The inflatable surfing apparatus 200 may be configured to be a mobile apparatus that is capable of being transported or shipped from one geographic location to another or may be configured to be assembled in one location where it is designed to permanently or temporarily reside. The inflatable surfing apparatus 200 includes a base 210 that may provide support for one or more elements of the inflatable surfing apparatus 200.

The base 210 may be manufactured out of a single component or may be made up of a plurality of components that are connected together to form the entire base 210. In certain embodiments, the base 210 may be made out of a rigid or semi-rigid material (e.g., metal, concrete, plastic, fiberglass, etc.) to aid in providing increased stability for the inflatable surfing apparatus 200 as a whole. A more rigid base 210 may allow it to be used or operated by users with reduced risk of tipping over, or otherwise entering an orientation that is undesirable for its intended use. In other embodiments, the base 210 may be inflatable or include inflatable portions itself and/or made of more malleable and less rigid materials. In one embodiment, the base 210 may be one or more sides or portions of a shipping container that was used to hold all or some of the components of the inflatable surfing apparatus 200. For example, as previously discussed in FIG. 1, one or more sides of a shipping container may be configured to be removable and/or capable of changing its orientation (e.g., rotate) with respect to other sides of the shipping container and such sides may be used to form all or a portion of the base 210. A plurality of sides of a shipping container may be configured to rotate into a substantially flat orientation in order to provide a stable surface as part of the base 210. A single side of a shipping container that is removable from the other sides of the shipping container may be used as a stable surface as part of the base 210 and/or reconnected with other sides of the shipping container to form all or part of the base 210.

The inflatable surfing apparatus 200 includes a variety of other components, including one or more stairs (230, 232), a ride surface 220, a drainage surface 225, and a fluid delivery mechanism 240 (e.g., water nozzles or jets, sluice, etc.). During operation, water may be configured to flow from the fluid delivery mechanism 240, along the ride surface 220 and over the drainage surface 225. The water may then be configured to drain through the drainage surface 225, for example, to a reservoir or storage tank located beneath the drainage surface 225 and/or the ride surface 220 where the water may subsequently be pumped or otherwise provided back to the fluid delivery mechanism 240 for subsequent reintroduction over or along the ride surface 220.

An area 250 of the inflatable surfing attraction 200 (e.g., a removable panel that made be made up fully or in part by a portion of a shipping container, such as one or more of the sides of the shipping container) may be capable of being moved in order to service or otherwise obtain access to the interior of the surfing attraction 220, such as the area beneath the ride surface 220. In an alternative embodiment, a fully or partially enclosed shipping container may be used for housing various components (e.g., water-sensitive components such as electronics), rather than just a panel that is positioned underneath all or a portion of the drainage surface 225, the ride surface 220, and/or another portion of the surfing apparatus 200. For example, the inflatable surfing attraction 200 may include a cavity or volume that is capable of accepting all or a portion of a shipping container therein. Holes, conduits, or other connections (e.g., mechanical and/or electrical) may be positioned on an exterior or at an exterior of the shipping container in order to facilitate access to equipment that is to be stored within the shipping container during operation of the surfing attraction 200.

In one embodiment, the ride surface 220 may be fully or partially inflatable (e.g., may be made of an inflatable drop-stitch material) that may provide a more comfortable landing material in the case of a user losing their balance while attempting to surf or perform water skimming maneuvers upon the ride surface 220 (e.g., using only their body or using other ride vehicles such as body or surf boards). One or more sidewalls 212 may be disposed around a perimeter of the ride surface 220. In one embodiment, these one or more sidewalls 212 may be fully or partially inflatable. In another embodiment, these one or more sidewalls 212 may be partially or fully constructed of sides of the shipping container (e.g., the shipping container 100) that was used for shipment of the inflatable surfing apparatus 200 during transport.

In such an embodiment, stable perimeter elements made up of durable material (e.g., metal) that was previously used for defining a housing for transport may be re-used during the setup and/or operation phase for the inflatable surfing apparatus 200. One or more components of the inflatable surfing apparatus may be anchored and/or fastened together (e.g., the sidewall 212 may be fastened with the base 210). In an alternative embodiment, any of a variety of possible components (either inflatable or not, and/or part of a shipping container or not) may be connected with one another for stability or other purposes. Such a system or feature may be desirable since the empty or partially empty shipping container, after transport of the inflatable surfing apparatus 200, would conventionally require a large footprint or area for storage (or require transport to another geographic location) until a time that the inflatable surfing apparatus 200 is to be shipped to a new location.

In one example, all or a portion of a housing that defined the shipping container may be used during operation of the ride, for example, to hide or store various mechanical or electrical devices for which it would be undesirable for users to see or potentially interfere with (e.g., water pumps, electrical components, etc.). Moreover, in certain embodiments, all or a portion of the housing that defined the shipping container may include additional sound proofing elements or materials in an effort to reduce noise generated by one or more equipment during operation. Audio components such as speakers, lighting or video elements, photography devices, etc. or other components that may act to further enhance the ride experience of the surfing apparatus 200 (e.g., playing music or other sound effects, displaying video feeds, etc.) for customer enjoyment may be safely contained within the shipping container that is adjacent or housed at least partially within the assembled surfing attraction 200 during operation.

The inflatable surfing apparatus 200 may be configured to automatically inflate upon setup. For example, after shipment, various sides or parts of the shipping container may be removed, modified, or otherwise placed to stabilize and/or to provide desirable mounting or anchoring surfaces for one or more inflatable portion of the inflatable surfing apparatus 200 and an automatic inflation system initiated. Such a system may include components to dynamically monitor pressure or other characteristics during inflation such that user intervention is reduced during inflation. For example, such a system may automatically inflate various portions of the inflatable surfing apparatus to different pressures, automatically reducing or halting inflation upon reaching predetermined thresholds for such portions. Other embodiments may not automatically inflate and/or may include devices that require some manual manipulation in order to inflate. In such embodiments, inflating equipment such as air pumps, etc. may be stored within the shipping container that is connected with the assembled surfing apparatus 200. In an alternative embodiment, the inflatable surfing apparatus 200 may not include any inflatable portions, but may still utilize one or more sides or parts of a shipping container in its deployed orientation.

Figure 3:
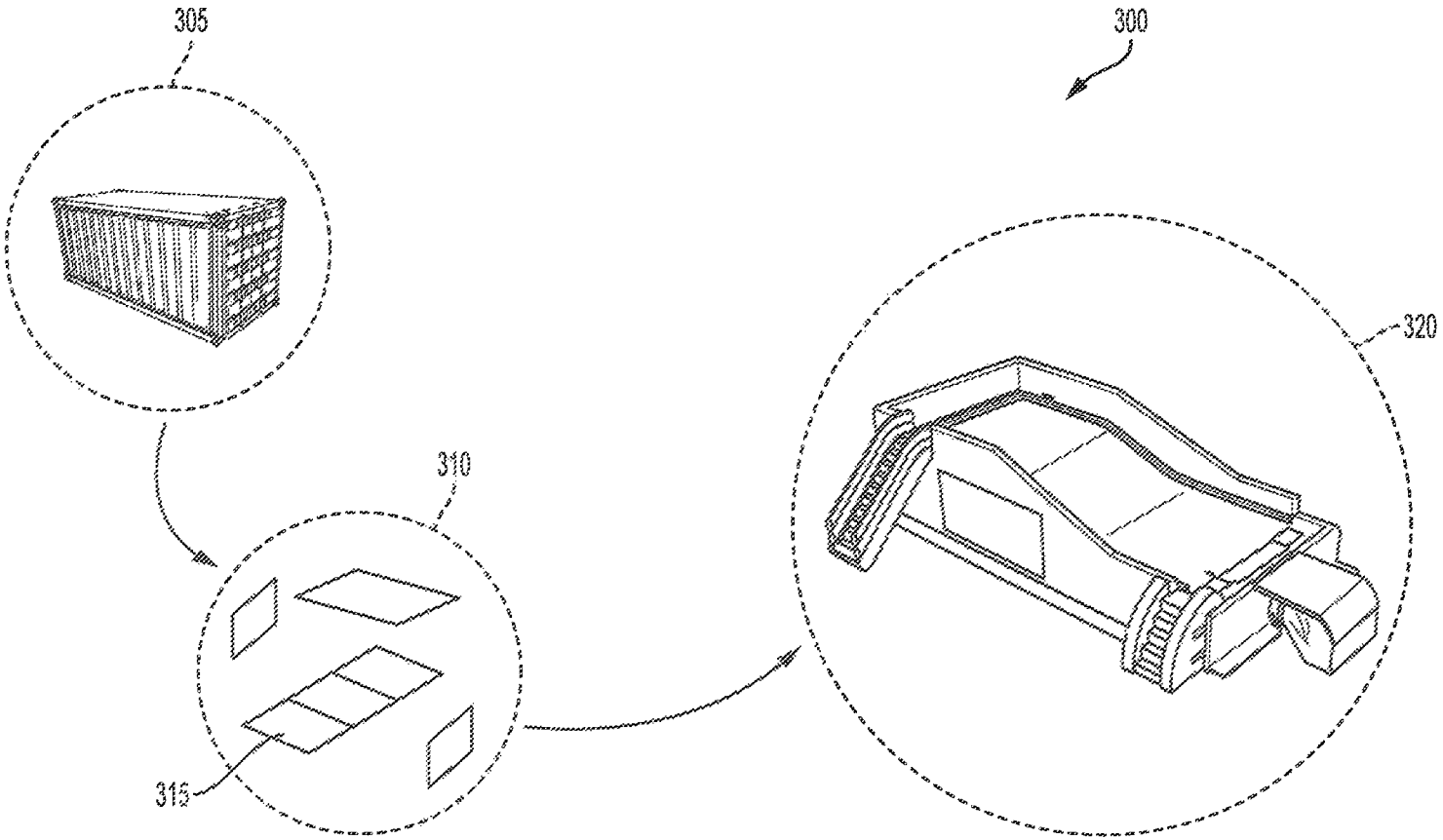
FIG. 3 shows stages of an inflatable surfing apparatus assembly via a shipping container used to house one or more components of the inflatable surfing apparatus according to an embodiment of the present invention.

FIG. 3 shows stages 300 of an inflatable surfing apparatus assembly via a shipping container used to house one or more components of the inflatable surfing apparatus. The assembly, shipment, shipping container, and/or inflatable surfing apparatus may include features that are the same as or similar to those previously discussed. For example, in a first stage 305, a shipping container or vehicle may be used to shipment or transport of one or more components of a surfing apparatus. The shipping container or vehicle may be in a transporting configuration in the first stage 305. In a second stage 310, one or more sides or portions 315 of the shipping container or vehicle may be disassembled from one another and/or pivoted, rotating, and/or moved relative to one another in order to form one or more components that may be used during the further assembly of the surfing apparatus. Finally, in a third stage 320, the surfing apparatus may be assembled using the one or more sides or portions 315 of the shipping container or vehicle. The shipping container and/or vehicle in the second stage 310 and/or the third stage 320 may be in a deployed configuration. As previously noted, any of a variety of attractions or structures (whether inflatable or not, surfable or not, amusement attraction-based or not) may utilize one or more of the features disclosed throughout, in alternative embodiments.

The previous description of the disclosed examples is provided to enable any person of ordinary skill in the art to make or use the disclosed methods and apparatus. Accordingly, the terminology employed throughout should be read in a non-limiting manner. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A system for transporting a surfing apparatus, comprising:

a housing having at least a first side and a second side;

a ride surface configured to be disposed within the housing during transport of the housing from a first geographic location to a second geographic location, at least a portion of the ride surface being inflatable; and a water delivery mechanism configured to be disposed within the housing at least during transport of the water delivery mechanism from the first geographic location to the second geographic location, wherein the first side is configured to be modified relative to the second side for deployment of the ride surface at the second geographic location via fastening the ride surface with the first side at the second geographic location, the first side being disposed underneath the deployed ride surface creating a cavity therebetween, and wherein at least a portion of the housing is contained within the cavity between the deployed ride surface and the first side.

2. The system of claim 1 wherein the housing is a crate having six sides.

3. The system of claim 1 wherein the housing is constructed at least partially out of metal.

4. The system of claim 1 wherein the ride surface is constructed of a drop-stitch material.

5. The system of claim 1 wherein the water delivery mechanism is a nozzle.

6. The system of claim 1 wherein the modification of the first side with respect to the second side comprises removing the first side from the second side.

7. The system of claim 6 wherein the first side is configured to be removed from the second side via at least one bracket that is configured to allow removal and subsequent reconnection of the first side to the second side.

8. The system of claim 1 wherein the modification of the first side with respect to the second side comprises rotating the first side while the first side remains connected with the second side.

9. The system of claim 8 wherein the first side is configured to be rotated via at least one hinge.

10. The system of claim 1 wherein the first side is configured to be positioned upon a ground surface and operate as a stable base for the fastening of the ride surface thereto for use of the ride surface by the one or more riders.

11. A system for transporting an amusement attraction, comprising:

a housing having a transporting configuration and a deployed configuration; and an inflatable ride surface contained completely within the housing and connected with a portion of the housing when in the transporting configuration, wherein the housing is configured to convert from the transporting configuration to the deployed configuration such that a first portion of the housing is positioned underneath and connected with the ride surface to form a reservoir for a body of water when the housing is in the deployed configuration, and wherein a second portion of the housing is completely contained within the reservoir formed between the first portion of the housing and the ride surface when the housing is in the deployed configuration.

12. The system of claim 11 wherein the conversion of the housing from the transporting configuration to the deployed configuration includes disconnection of the first portion of the housing from the second portion of the housing.

13. The system of claim 12 wherein the housing is configured to be converted from the deployed configuration to the transporting configuration by reconnection of the first portion of the housing to the second portion of the housing.

14. The system of claim 11 wherein the conversion of the housing from the transporting configuration to the deployed configuration includes pivoting the first portion of housing with respect to the second portion of the housing via a hinge.

15. A system for shipping a water attraction, comprising:

a housing having a transporting configuration and a deployed configuration; and a ride surface configured to be disposed within the housing during transport of the housing when the housing is in the transporting configuration, wherein the housing is configured to convert from the transporting configuration to the deployed configuration such that a first side of the housing is positioned underneath the ride surface to form a cavity between the ride surface and first side of the housing when the housing is in the deployed configuration, and wherein a second portion of the housing is at least partially contained within the cavity when the housing is in the deployed configuration.

16. The system of claim 15 wherein the first side of the housing is permanently connected with the ride surface when the housing is in the transporting configuration and the deployed configuration.

17. The system of claim 15 wherein the second portion of the housing is configured to prevent water from entering an interior space of the second portion of the housing when in the deployed configuration.

18. The system of claim 17 wherein the housing further comprises an electrical connection along an exterior portion of the housing for interfacing with electrical components within the housing when in the deployed configuration.

19. The system of claim 17 wherein the housing further comprises a mechanical connection along an exterior portion of the housing for interfacing with mechanical components within the housing when in the deployed configuration.

* * * * *